United States Patent [19]

Patenaude

[11] 4,114,511

[45] Sep. 19, 1978

[54] ENDLESS CONVEYOR MECHANISM

[75] Inventor: Raymond Arthur Patenaude, Burlington, Vt.

[73] Assignee: General Electric Company, Burlington, Vt.

[21] Appl. No.: 800,510

[22] Filed: May 25, 1977

[51] Int. Cl.[2] ..... F42B 39/08

[52] U.S. Cl. ..... 89/33 CA; 89/35 R; 198/479; 198/655; 198/695

[58] Field of Search ..... 89/33 BC, 33 CA, 35 R; 198/479, 653, 655, 694, 695; 214/1 BA; 221/76

[56] References Cited

U.S. PATENT DOCUMENTS 2,389,960 11/1945 Dobremysl ..... 89/35 R

*Primary Examiner*—Stephen C. Bentley

*Attorney, Agent, or Firm*—Bailin L. Kuch

[57] ABSTRACT

An ammunition conveyor system comprising a series of rigid U-shaped conveyor elements, each element having resilient means secured thereto for releasably retaining a cartridge case to said element, and a series of rigid links, each link respectively intercoupling two adjacent elements, said resilient means also serving to releasably capture the two intercoupling links to the respective element.

12 Claims, 10 Drawing Figures

Fig. 6.
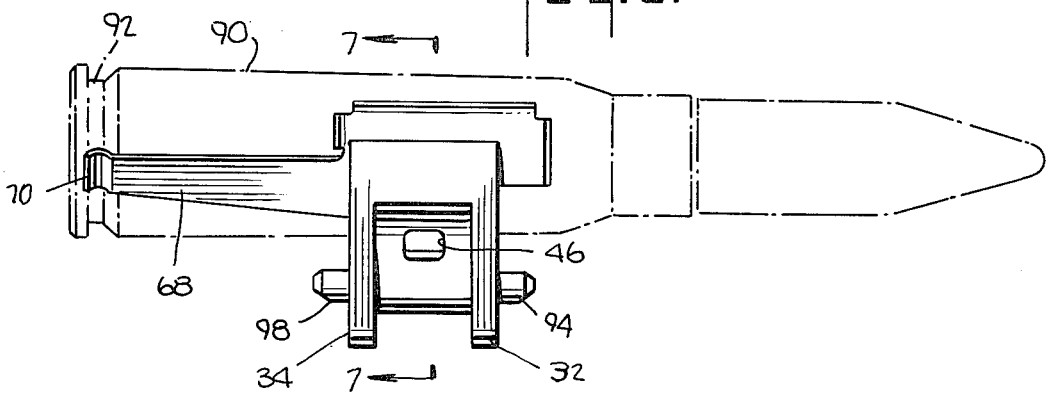
Fig. 7.
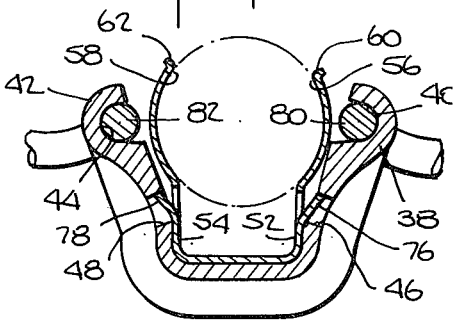
Fig. 9.
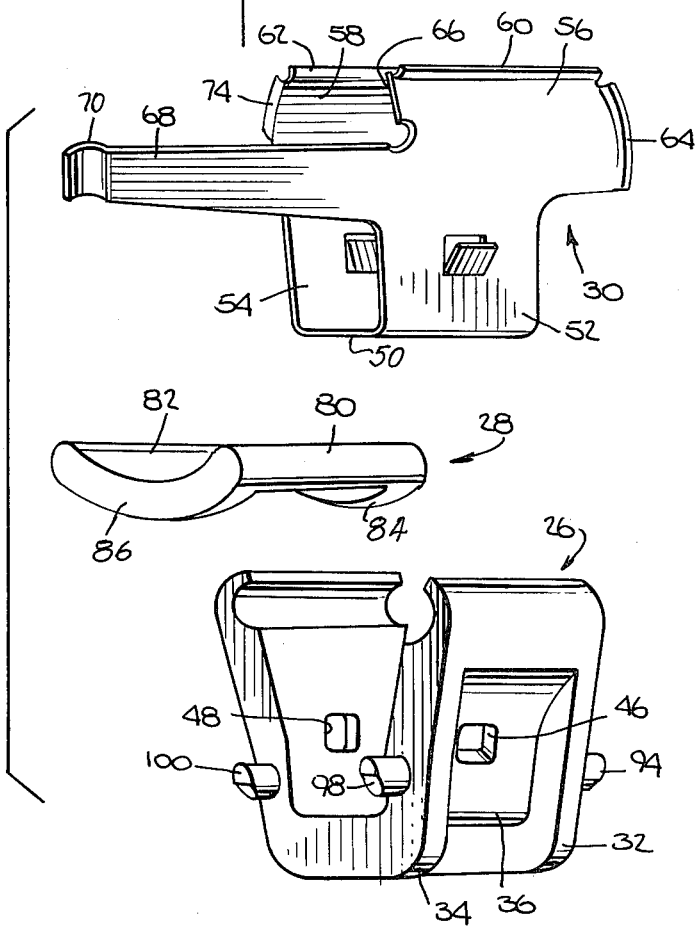
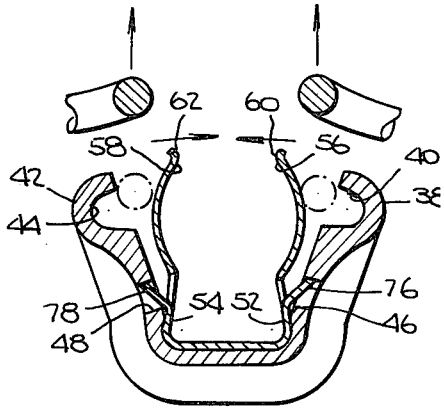
Fig. 8.

ENDLESS CONVEYOR MECHANISM

BACKGROUND OF THE INVENTION

1. Field of the Invention

This invention relates to endless conveyor systems, and particularly to such systems which travel into an automatic gun which has a rotating barrel cluster and supply ammunition thereto.

2. Prior Art

An endless conveyor system is shown by Kirkpatrick in U.S. Pat. No. 3,429,221, issued Feb. 25, 1969. Each conveyor element carries a single round of ammunition which is restrained in the element by external, fixed guide rails. Each element hands off its round to a sprocket which passes the round into the gun. Bangerter in U.S. Pat. No. 1,424,751, issued Aug. 8, 1922, shows a gun wherein a belt of ammunition in clips is passed in synchronism adjacent an endless belt of explosion chambers. The rounds are transferred from the clips into the chambers, and the chambers are subsequently passed into the gun. Patenaude et al in U.S. Pat. No. 3,834,272, issued Sept. 10, 1974, shows a belt of resilient links, or conveyor elements, which travels into the gun for supplying ammunition thereto. Each round is end-stripped by a respective gun bolt while the element is aligned with a respective barrel, loaded, locked, fired, unlocked, extracted and the empty case is returned to the original respective element by the bolt. The links are resilient and, therefore, the length of the conveyor when it is under tension is not constant. Dixon in U.S. Pat. No. 2,780,963, issued Feb. 12, 1957, shows a belt of cartridge clips, each of which is adapted to be end-loaded and end-stripped. The inner clip is made of resilient metal and a heavier metal onsert is provided around the clip. The onsert has resilient arms which, together with resilient arms of the inner clip, engage rings which intercouple adjacent clips. The links are resilient and, therefore, the length of the belt when it is under tension is not constant.

It is an object of this invention to provide an ammunition conveyor system which is of constant length when under tension and in which each conveyor element resiliently captures the cartridge case of a round of ammunition.

It is another object of this invention to provide such a system which is adapted to pass into an automatic gun having a rotating barrel cluster, and around said cluster, to permit the direct transfer of a round of ammunition from each element conveyor to a respective gun barrel, and the return of the fired case to that same conveyor element.

It is yet another object of this invention to provide such a system wherein each conveyor element may be both side-loaded and side-extracted and end-loaded and end-extracted.

It is even yet another object of this invention to provide such a system wherein each conveyor element is adapted to clear a centrifugally directed projection on a bolt as the respective round is stripped from the conveyor element by such bolt.

A feature of this invention is the provision of an ammunition conveyor system comprising a series of rigid U-shaped conveyor elements, each element having resilient means secured thereto for releasably retaining a cartridge case to said element, and a series of rigid links, each link respectively intercoupling two adjacent elements, said resilient means also serving to releasably capture the two intercoupling links to the respective element.

BRIEF DESCRIPTION OF THE DRAWING

These and other objects, features and advantages of the invention will become apparent from the following specification thereof taken in conjunction with the accompanying drawing in which:

FIG. 6 is a side view of the assembly of FIG. 4;

FIG. 7 is a transverse view in cross-section taken along plane VII—VII of FIG. 6;

FIG. 8 is a transverse view in cross-section, similar to FIG. 7, with a conveyor element decoupled from adjacent elements;

FIG. 9 is an exploded view of the parts of the conveyor element; and

DESCRIPTION OF THE INVENTION

Figure 2:
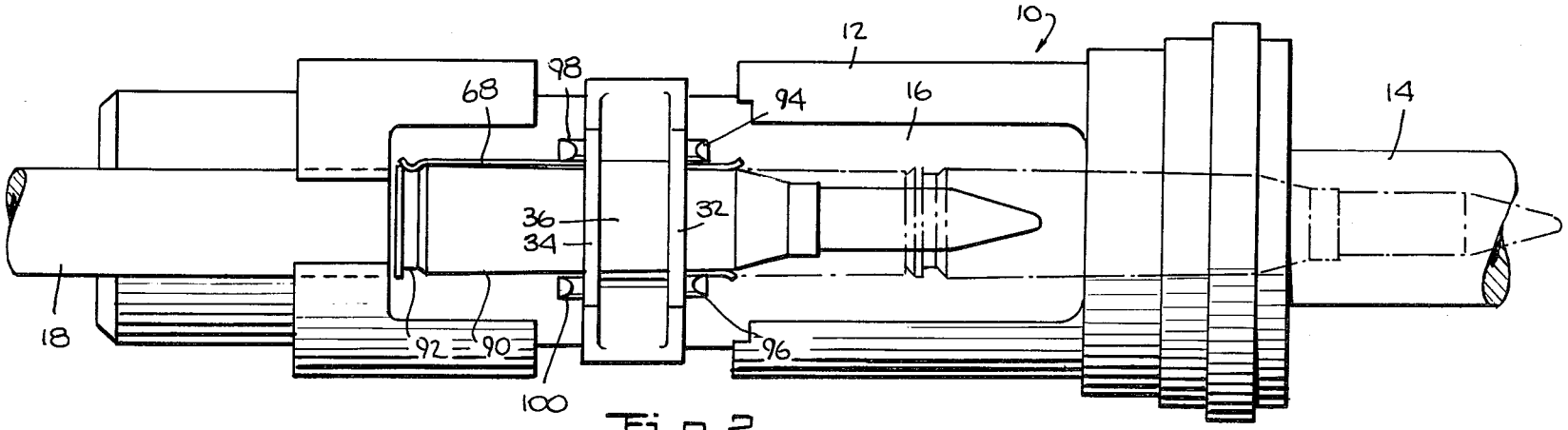
FIG. 2 is a top view, with some parts omitted, of the cluster and conveyor of FIG. 1.
Figure 1:
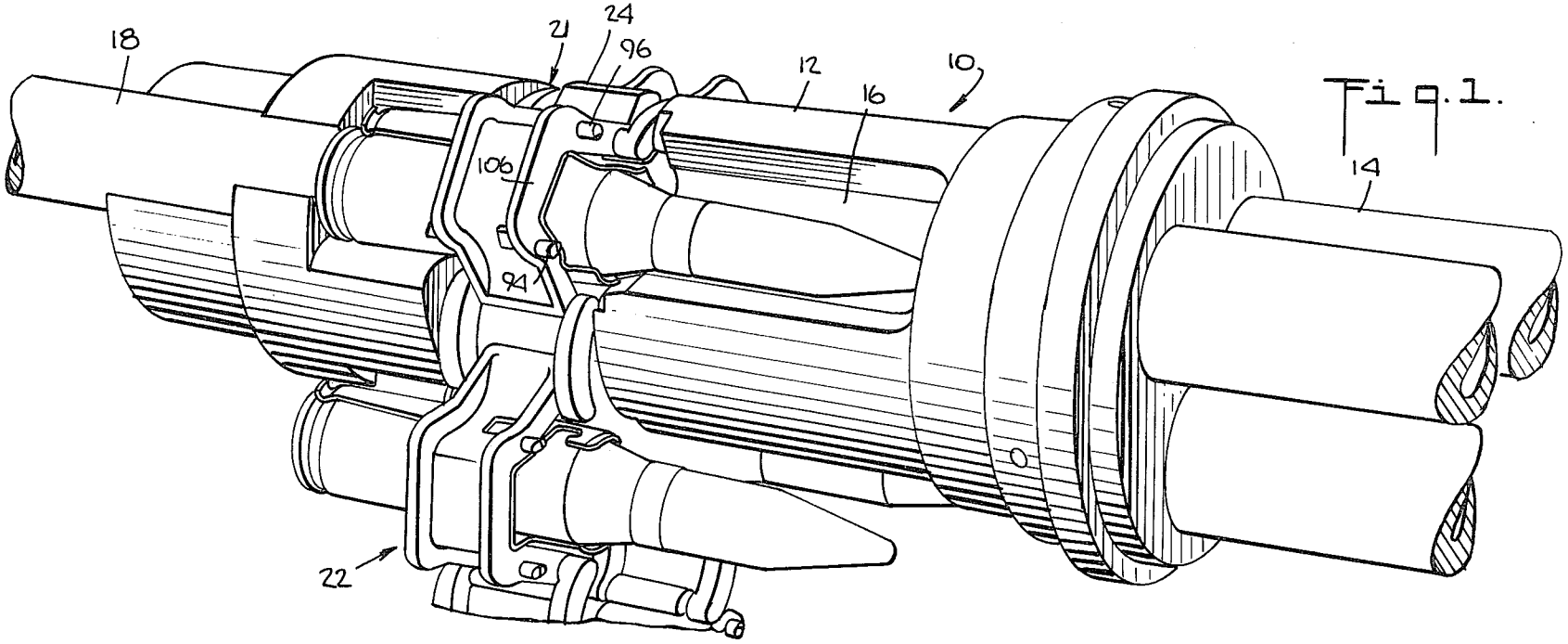
FIG. 1 is a perspective view of a rotating barrel cluster of an automatic gun of the type shown in U.S. Pat. No. 3,834,272 with an endless conveyor for ammunition embodying this invention.
Figure 3:
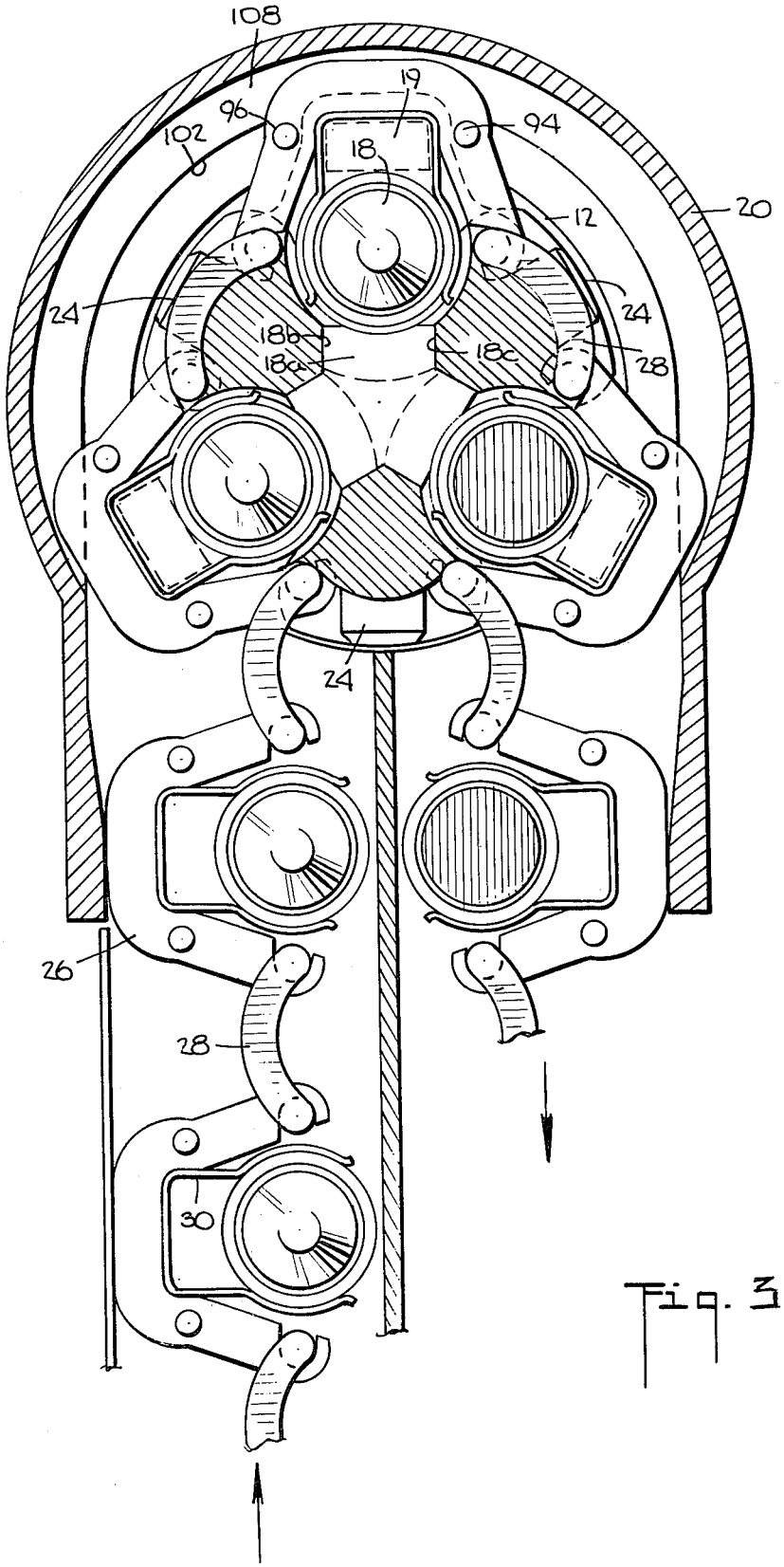
FIG. 3 is a transverse view in cross-section of the cluster and conveyor of FIG. 1 in a gun housing.
Figure 4:
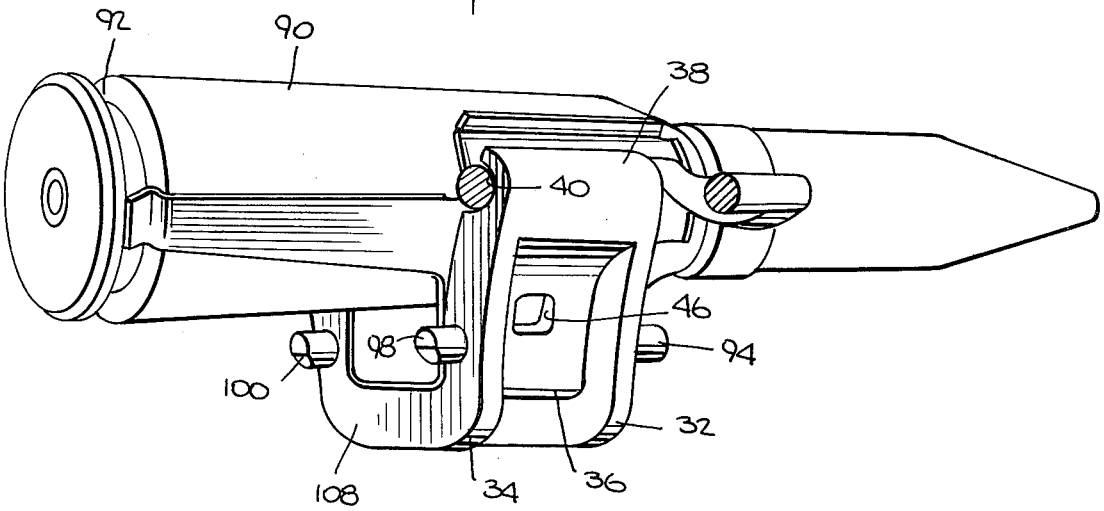
FIG. 4 is a perspective of a conveyor element of the endless conveyor of FIG. 1 with a round of ammunition.
Figure 5:
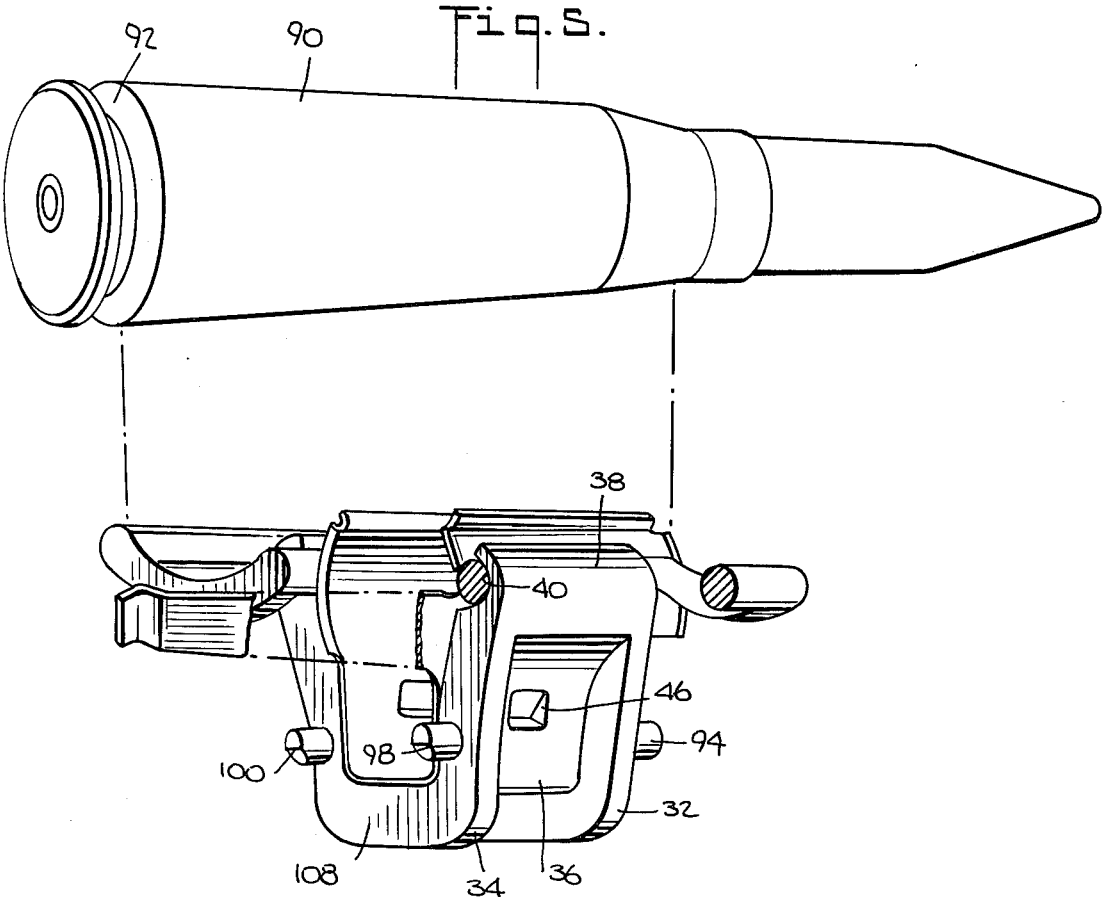
FIG. 5 is a perspective view, similar to FIG. 4, with the round stripped out.

The rotating barrel cluster 10 shown in FIGS. 1, 2 and 3 is similar to the cluster utilized in the gun shown in U.S. Pat. No. 3,834,272. The cluster includes a rotor 12 to which are secured three gun barrels 14. The barrels are respectively aligned with three channels 16 in which are respectively disposed three gun bolts 18. The cluster is journaled for rotation in a housing 20. The principle of operation was early shown by R. J. Gatling in U.S. Pat. No. 125,563, issued on Apr. 9, 1872. Briefly, as the cluster rotates in the housing, suitable means, such as the helical drum cam track operating on gun bolt cam follower rollers as shown in U.S. Pat. No. 125,563, or the actuator rod operating on gun bolt tangs as shown in U.S. Pat. No. 3,834,272, reciprocates each gun bolt in its respective channel, so that it may strip, load, lock, fire, unlock, eject and discharge a round of ammunition during each cycle of rotation of the cluster.

A peripheral passageway 21 is cut into the rotor 12 to receive an endless conveyor 22. Three teeth 24 project from the passageway and serve as a three-toothed sprocket wheel to engage and drive the conveyor around the cluster.

The endless conveyor 22 comprises a series of substantially U-shaped rigid elements 26 intercoupled by substantially rectangular rigid links 28. A substantially U-shaped resilient retainer 30 is fixed within and to each element 26.

Each element 26 integrally comprises a U-shaped forward, transverse, flange 32, a U-shaped aft, transverse, flange 34, and an intermediate U-shaped longitudinal web 36. The two webs and the flange merge at the distal portions of the element to provide a right cylindrical, longitudinally extending knuckle 38 having a longitudinally extending channel 40 which, in cross-section, is U-shaped, centripetally open and a similar left cylindrical, longitudinally extending knuckle 42 having a longitudinally extending channel 44 which, in cross-section, is U-shaped, centripetally open. The right arm of the web 36 has an aperture 46 and the left arm has a similar aperture 48. The retainer 30 has a base portion 50 from which up-stand two relatively flat right and left portions 52 and 54, which respectively extend into arcuate right and left portions 56 and 58, which respectively terminate in right and left lips 60 and 62. The right arcuate portion 56 has a forwardly disposed lip 64 and an aftwardly disposed lip 66 and an aftwardly directed arm 68 which terminates in a centripetally directed knuckle bend 70. The left arcuate portion 58 has a forwardly disposed lip and an aftwardly disposed lip 74. The right flat portion 52 has a centrifugally bent out tab 76 and the left flat portion has a centrifugally bent out tab 78. The retainer 30 is assembled to the element 26 by seating the retainer into the element so that the tabs 76 and 78 respectively snap into the aperatures 46 and 48.

Each link 28 comprises a pair of right and left longitudinally extending rods 80 and 82, connected at their forward ends by a forward, arcuate web 84, and at their aft ends by an aft, arcuate web 86. The radius of curvature of the webs 84 and 86 is equal to the radius of curvature of the base of the peripheral passageway 20 in the rotor 12. The right rod 80 is snapped into the left channel 44 of one element 26 by deflecting the left arcuate portion 58 of its retainer 30 and is loosely retained thereby. The left rod 82 is snapped into the right channel 40 of the next adjacent element by deflecting the right arcuate portion 56 of its retainer, and is loosely retained thereby, as shown in FIG. 8.

A cartridge case 90 of a round of ammunition may be snapped into a retainer 30 by side-loading between the upper lips 60 and 62, by front-end-loading between the forward lips 64, or by aft-end-loading between the aft lip 74 and the right lip 66 and the arm 68. The case may be similarly side-stripped, front-end stripped and aft-end stripped. The knuckle bend 70 is adapted to enter the extractor groove 92 of the case to longitudinally align the case in the element, while the arcuate portions 56 and 58 serve to transversely align the case in the element.

Two spaced apart pins 94 and 96 are fixed to and extend forwardly from the forward flange 32, and two spaced apart pins 98 and 100 are fixed to and extend aftwardly from the aft flange 34. As a given conveyor element approaches the rotor, a tooth 24 swings into the immediately preceding link 28, between the right knuckle 38 of the immediately preceding element and the left knuckle 42 of the given element. The left knuckle fits into and pivots in a cylindrical concavity at the left side of the base of the tooth while the right knuckle fits into and pivots in a cylindrical concavity at the right side of the base of the tooth. The forward pins 94 and 96 ride under and are guided by a forward inner arcuate surface 102 provided on the housing 20, while the aft pins 98 and 100 ride under and are guided by a similar aft inner arcuate surface on the housing. The four pins and the housing surfaces, and the immediately preceding and following teeth and the knuckles serve to accurately locate the element radially, and the cartridge case carried thereby, with respect to the respective bolt 18. The lower front face 106 of the forward flange 32 and the lower aft face 108 of the aft flange 34 are respectively guided between a forward, rear facing, transverse surface 110 on the housing and a similar aft, forward facing, transverse surface on the housing, which serve to accurately locate the element longitudinally.

The gun bolt 18 is cylindrical in cross-section and has a lower roller **18*a* which rides between guide surfaces 18*b* and 18*c* of the rotor to prevent rotation of the bolt about its own longitudinal axis. The bolt also has an upper roller 19 which rides in a helical cam track, not shown, to reciprocate the bolt. When the bolt comes forward to end-strip the round, the roller 19 passes within the conveyor element 26**, while the forward portion of the bolt maintains the retainer in its deflected open position. When the bolt returns aft, it end-loads the cartridge case in the retainer.

The center of pull through the endless conveyor is through the center of gravity of the conveyor element and its cartridge in both planes. The elements transmit loads in tension and due to the rigid structure of the element 26 exhibit no significant deflection, that is, enlargement of pitch, under working load.

The passage of the elements through chuting is not affected by any number of missing cartridges or by a mix of loaded rounds and empty cases. The pairs of pins 94 and 96, and 98 and 100, ride in respective guide channels in the chuting and thereby provide full control of the respective elements.

Figure 10:
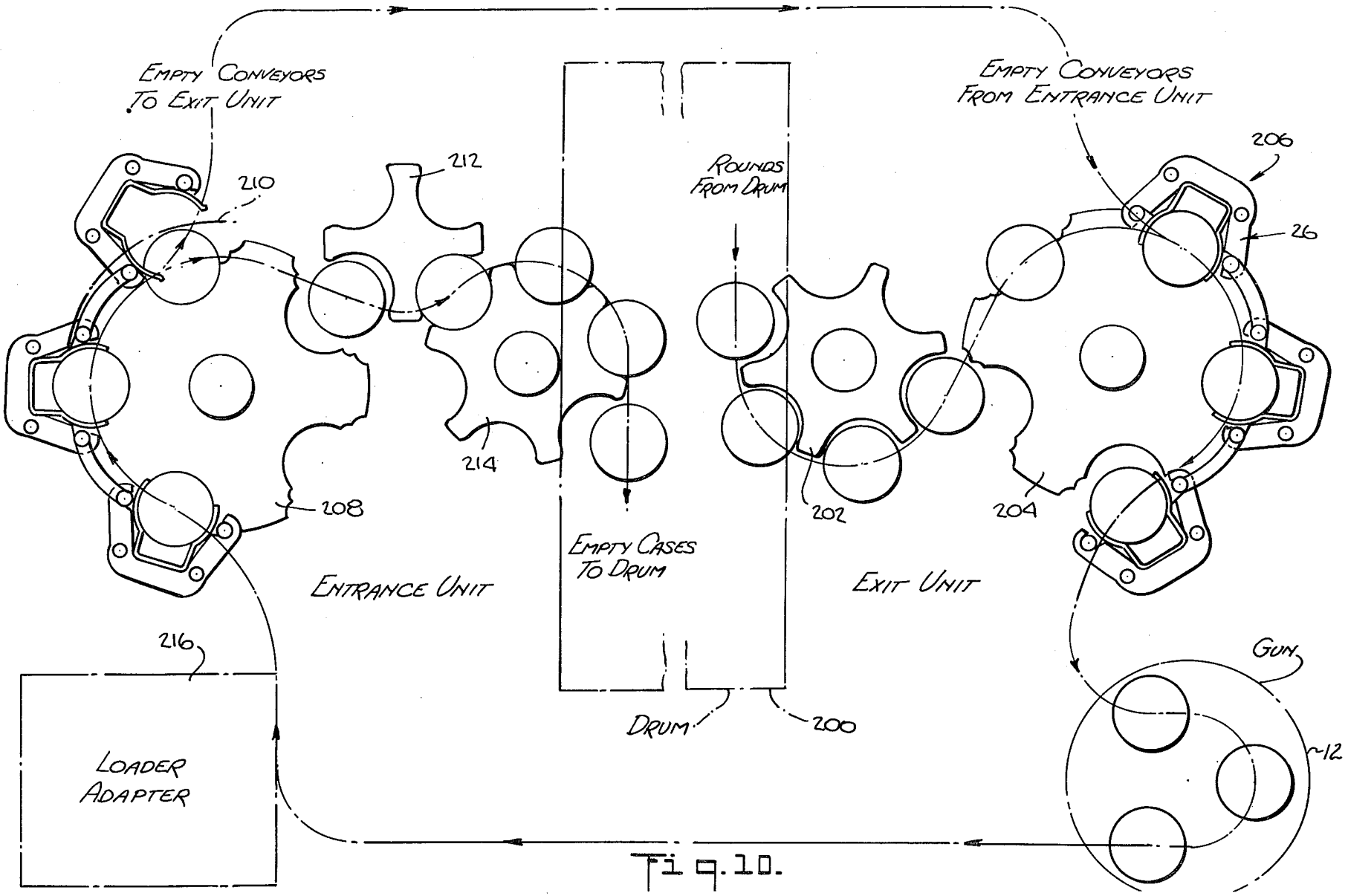
FIG. 10 is a schematic diagram of a system for supplying the endless conveyor of FIG. 1 with rounds of ammunition from an ammunition supply system.

A system for storing unlinked rounds of ammunition and for transferring them to the endless conveyor, and for receiving empty cases and unfired rounds from the conveyor is shown in FIG. 10, and is quite similar to the system shown by Backus et al in FIG. 10 of U.S. Pat. No. 3,696,704, issued Oct. 10, 1972. The linkless rounds are stored in a drum storage 200, are scooped out to an exit sprocket 202, which hands them off to a transfer sprocket 204 (considered part of the drum storage exit unit) which also meshes with the endless conveyor 206 so that each round in sequence is side-loaded into a respective conveyor element. Suitable guides for the conveyor and the ammunition are provided, but not here shown. Each loaded element 26 passes in sequence into the gun, and meshes with the rotor 12. The respective gun bolt end-strips the round from the element forwardly into the respective gun chamber and after firing end-loads the fired case aftwardly into the element. The element passes out of the gun to mesh with a transfer sprocket 208 whereat a stripping guide 210 side-strips the fired case out of the element and passes it to an idler sprocket 212 which hands it to an entrance sprocket 214 which restores it to the drum storage. The sprockets 210, 212 and 214 are considered part of the drum storage entrance unit. The empty conveyor elements continue on the transfer sprocket 204 to receive fresh rounds. A loader adapter 216, containing a sprocket and two guide assemblies to alternatively side-load or side-strip rounds into the elements, is provided on the run of the conveyor between the gun and the entrance unit.

What is claimed is:

1. A conveyor system comprising:

a plurality of rigid, substantially U-shaped conveyor elements disposed in a series;

a like plurality of resilient means, each resilient means secured to a respective conveyor element, for releasably retaining an article to said conveyor element; and a plurality of rigid links, each link respectively disposed between and intercoupling two adjacent conveyor elements;

each of said resilient means also serving to releasably capture the respective two intercoupling links to the respective conveyor element.

2. A system according to claim 1 wherein:

each of said resilient means includes a substantially U-shaped spring element having a pair of spaced apart arms.

3. A system according to claim 1 wherein:

each of said conveyor elements has a pair of spaced apart knuckles, each knuckle having a groove facing the other knuckle;

each of said links including a pair of spaced apart rods, each of said rods disposed in the groove of a respective knuckle of two adjacent conveyor elements.

4. An automatic gun including:

a housing;

a rotor journaled for rotation on a longitudinal axis in said housing;

a plurality of gun barrels secured to said rotor, a like plurality of gun bolt channels provided in said rotor respectively aligned with said gun barrels, a like plurality of gun bolts respectively disposed in said gun bolt channels, a transverse sprocket having a plurality of teeth provided on said rotor;

a conveyor system including a plurality of rigid, substantially U-shaped conveyor elements disposed in a series, a like plurality of resilient means, each resilient means secured to a respective conveyor element, for releasably retaining an article to said conveyor element, a plurality of rigid links, each link respectively disposed between and intercoupling two adjacent conveyor elements, each of said resilient means also serving to releasably capture the respective two intercoupling links to the respective conveyor element;

said conveyor system meshed with and driven by said teeth of said rotor sprocket, with each of said plurality of resilient means in sequence being aligned with a respective gun bolt and gun barrel.

5. A gun according to claim 4 wherein:

each of said resilient means includes a substantially U-shaped spring element having a pair of spaced apart arms.

6. A gun according to claim 4 wherein:

each of said conveyor elements has a pair of spaced apart knuckles, each knuckle having a groove facing the other knuckle;

each of said links including a pair of spaced apart rods, each of said rods disposed in the groove of a respective knuckle of two adjacent conveyor elements.

7. A gun according to claim 6 wherein:

each of said resilient means includes a substantially U-shaped spring element having a base portion extending into two spaced apart lower arm portions respectively extending into two spaced apart mutually opposed concave portions, said concave portions serving to releasably retain therebetween the cartridge case of a round of ammunition, said concave portions also serving to releasably retain said rods in the grooves of the respective knuckles of the respective conveyor element.

8. A gun according to claim 6 wherein:

each of said teeth of said rotor sprocket has a pair of longitudinally extending cylindrical concavities therein, each of said concavities for serving as pivot-bearing surface for a respective knuckle.

9. A gun according to claim 8 wherein:

each of said teeth of said rotor sprocket in sequence projects through a respective link in sequence with the trailing knuckle of the leading conveyor element entering the leading cylindrical concavity of said tooth and the leading knuckle of the next adjacent trailing conveyor element entering the trailing cylindrical concavity of said tooth.

10. A gun according to claim 4 wherein:

each of said conveyor elements includes two spaced apart guide elements projecting longitudinally forwardly, and two spaced apart guide elements projecting longitudinally aftwardly, said housing includes a forward arcuate guide surface for receiving said conveyor element forwardly projecting guide elements, and an aftward arcuate guide surface for receiving said conveyor element aftwardly projecting guide elements, whereby said guide surfaces guide said conveyor elements in sequence onto and around said rotor.

11. A gun according to claim 5 wherein:

each of said gun bolts has a centrifugally diverted projection;

said bolts and conveyor elements having a mode of operation such that each bolt with its projection passes between said spaced apart arms of said spring element of the respective conveyor element.

12. A gun according to claim 6 wherein:

said rotor sprocket has a hub from which said teeth project having a peripheral surface having a certain angle of curvature; and each of said links has a pair of longitudinally spaced apart, rigid, curved arms fixed to and between said pair of spaced apart rods, said arms having said certain angle of curvature.

* * * * *